US011284727B2

(12) United States Patent
Bernardo

(10) Patent No.: US 11,284,727 B2
(45) Date of Patent: Mar. 29, 2022

(54) MODULAR AND COLLAPSIBLE CHAIR FOR CHILDREN AND METHOD THEREOF

(71) Applicant: Adrianne F. Bernardo, West Haven, UT (US)

(72) Inventor: Adrianne F. Bernardo, West Haven, UT (US)

( * ) Notice: Subject to any disclaimer, the term of this patent is extended or adjusted under 35 U.S.C. 154(b) by 0 days.

(21) Appl. No.: 17/006,772

(22) Filed: Aug. 28, 2020

(65) Prior Publication Data

US 2021/0059428 A1 Mar. 4, 2021

Related U.S. Application Data

(60) Provisional application No. 62/895,086, filed on Sep. 3, 2019.

(51) Int. Cl.
*A47D 1/00* (2006.01)
*A47D 1/02* (2006.01)

(52) U.S. Cl.
CPC ..... *A47D 1/023* (2017.05); *A47D 1/004* (2013.01); *A47D 1/006* (2013.01); *A47D 1/0085* (2017.05)

(58) Field of Classification Search
CPC . A47D 1/008; A47D 1/02; A47D 1/04; A47D 1/0085; A61G 5/1094; A47C 7/68
USPC ..... 297/17, 139, 148, 150
See application file for complete search history.

(56) References Cited

U.S. PATENT DOCUMENTS 2,456,111 A * 12/1948 Creech ..... A47D 3/005 297/136
2,555,566 A * 6/1951 Bleck ..... A47D 1/103 297/152
3,909,061 A * 9/1975 Johnson ..... A47C 4/52 297/17
3,961,803 A 6/1976 Fleischer
3,967,833 A 7/1976 Fleischer
3,971,079 A 7/1976 Fleischer
4,193,630 A * 3/1980 Steele ..... A47C 4/52 297/17
4,453,764 A * 6/1984 Hennessy ..... A47D 1/0085 297/153
4,556,249 A 12/1985 Kassai
4,768,825 A 9/1988 Quinlan, Jr.
4,854,638 A * 8/1989 Marcus ..... A47D 1/103 297/256.11
5,183,311 A 2/1993 Meeker et al.
5,609,389 A * 3/1997 Longoria ..... A47D 1/0085 297/37
6,089,654 A 7/2000 Burstein
6,129,414 A 10/2000 Brevi
6,969,120 B2 * 11/2005 Levin ..... A47D 1/10 297/440.12
7,029,064 B2 4/2006 Chen
7,152,918 B2 12/2006 Berkes
7,490,895 B2 2/2009 Yeh
7,497,461 B2 3/2009 Emerson
7,600,810 B2 10/2009 Chen et al.
7,699,395 B1 * 4/2010 Bozarth ..... A47D 1/00 297/217.3

(Continued)

*Primary Examiner* — Sarah B McPartlin
(74) *Attorney, Agent, or Firm* — David L. Stott

(57) ABSTRACT

Devices, systems, and methods for assembling a modular chair are provided. The modular chair includes a seat portion and a tray portion removably coupled together. The modular chair can be assembled in multiple use positions and in a non-use compact position with a minimized footprint.

20 Claims, 7 Drawing Sheets

(56) References Cited

U.S. PATENT DOCUMENTS

| | | | |
|---|---|---|---|
| 7,735,911 | B2 | 6/2010 | Chen |
| 9,066,606 | B1 | 6/2015 | Archer-Hall |
| 2005/0017549 | A1 | 1/2005 | Chen |
| 2006/0125293 | A1 | 6/2006 | Yeh |
| 2006/0192414 | A1 | 8/2006 | Berkes |
| 2007/0024095 | A1 | 2/2007 | Chen |
| 2007/0029845 | A1 | 2/2007 | Riedl et al. |
| 2007/0040420 | A1 | 2/2007 | Li |
| 2007/0194609 | A1 | 8/2007 | Chen |
| 2008/0079291 | A1 | 4/2008 | Cheng |
| 2008/0129001 | A1 | 6/2008 | Emerson |
| 2009/0039684 | A1 | 2/2009 | Chen et al. |
| 2010/0072790 | A1 | 3/2010 | Pleiman et al. |
| 2010/0237666 | A1 | 9/2010 | Buckavich et al. |
| 2011/0062753 | A1 | 3/2011 | Kennedy et al. |
| 2012/0032491 | A1 | 2/2012 | Bergkvist |
| 2016/0242565 | A1 | 8/2016 | Van den Akker |
| 2016/0324330 | A1 | 11/2016 | Xu |

* cited by examiner

MODULAR AND COLLAPSIBLE CHAIR FOR CHILDREN AND METHOD THEREOF

CROSS-REFERENCE TO RELATED APPLICATIONS

The present application claims the benefit of U.S. Provisional Application No. 62/895,086, filed Sep. 3, 2019, the disclosure of which is hereby incorporated by reference in its entirety.

TECHNICAL FIELD

The present invention relates generally to high chairs for children and, more specifically, the present invention relates to modular and collapsible high chairs for children.

BACKGROUND

Traditional high chairs made for children are bulky and take-up a large footprint. Even traditional high chairs made to fold still hold a large footprint, still making it difficult to transport and store the foldable high chairs. Further, the folding type high chairs also remain elongated and inconvenient to carry. As such, it would be advantageous for a high chair to hold a minimized foot print that is more suitable for carrying, transportation and storage.

BRIEF SUMMARY OF THE INVENTION

The present invention is directed to devices, systems, and methods of a modular chair system for a child. In one embodiment, the modular chair system includes a seat portion and a tray portion. The seat portion includes a base seat, a back, a first arm and a second arm. The base seat extends to define an upper seat surface and a seat underside. The first and second arms are each pivotably coupled to the base seat so as to be moveable between an upright arm position and a compact arm position. The back is pivotably coupled to the base seat so as to be pivotably movable between an upright back position and a compact back position. The tray portion includes an upward facing surface defining a tray region and first and second arm rests. The first and second arm rests of the tray portion include underside structure extending to define respective first and second arm channels therein. Further, the first and second arm rests extend to rear end portions, the rear end portions at least partially extending to define respective first and second back channels therein. With this arrangement, the tray portion is removably coupled to the seat portion with the back positioned within the back channels and the first and second arms being positioned in the respective first and second arm channels.

In another embodiment, upon the tray portion being coupled to the seat portion, the tray portion is removable from the seat portion with movement in a single direction such that the upward facing surface moves directly away from the upper seat surface of the seat portion. In still another embodiment, upon the tray portion being removed from the seat portion, the first and second arms are pivotably movable to the compact arm position so that each of the first and second arms are positioned along the upper seat surface, and the back is pivotably moveable to the compact back position so that the back is positioned over the first and second arms to minimize the seat portion to a seat compacted position. In yet another embodiment, upon the seat portion being moved to the seat compacted position, the seat portion may be positioned and held between the first and second arm rests of the tray portion with a coupling structure.

In another embodiment, the seat portion includes multiple telescoping legs pivotably coupled to the seat underside, the multiple telescoping legs moveable between an elongated leg position and a compact shortened leg position, the compact shortened leg position being pivotable to extend along the seat underside of the seat portion. In another embodiment, the tray portion is a one-piece seamless monolithic structure. In still another embodiment, the modular chair further includes one or more straps coupled to the seat portion.

In accordance with another embodiment of the present invention, a modular chair system is provided. The modular chair system includes a seat portion and a tray portion. The seat portion is sized and configured to be moved between a seat structure position and a seat compact position. The seat portion defines a sitting surface, the seat structure position of the seat portion defining a back extending upright and vertically relative to the sitting surface. The tray portion is sized and configured to be assembled and coupled to the seat portion in both the seat structure position and the seat compact position. The tray portion includes an upward facing surface defining a tray region and first and second arm rests. The tray region and the first and second arm rests defining a u-shaped structure, the first and second arm rests extending to respective rear end portions, the rear end portions each defining a c-shaped channel therein. With this arrangement, upon the seat portion being in the seat structure position, the back of the seat portion is sized and configured to be inserted through the c-shaped channel of the tray portion such that the upward facing surface of the tray portion moves closer to the sitting surface of the seat portion in a direction substantially perpendicular to the sitting surface of the seat portion.

In another embodiment, the seat portion includes a base seat with first and second arms extending upright from the base seat in the seat structure position, the first and second arms pivotably coupled to the base seat such that the first and second arms are movable to pivot and overly the sitting surface in the seat compact position. In another embodiment, the back is pivotably coupled to the base seat such that the back is moveable to pivot and overly the pivoted first and second arms to move the seat portion to the seat compact position. In still another embodiment, the tray portion includes an underside surface defining arm holding structure such that, upon the back of the seat portion being inserted through the c-shaped channel of the tray portion, the arm holding structure is sized and configured to maintain the first and second arms in an upright position relative to the sitting surface.

In another embodiment, the seat portion includes a seat underside, the set underside including multiple telescoping legs pivotably coupled thereto, the multiple telescoping legs moveable between an elongated leg position and a compact shortened leg position, the compact shortened leg position being pivotable to extend along the seat underside of the seat portion. In another embodiment, the tray portion is a one-piece seamless monolithic structure. In still another embodiment, the modular chair system further includes one or more straps coupled to the seat portion, the one or more straps sized and configured to couple the seat portion, upon the seat portion being in the seat compact position, against an underside of the tray portion.

In accordance with another embodiment of the present invention, a method for collapsing a modular chair is provided. The method includes the steps of: moving a tray portion in a vertical direction from a seat portion by sliding c-shaped channels defined in the tray portion from a backrest of the seat portion; pivoting arms of the seat portion from an upright position to a compact arm position; pivoting the backrest from an upright position to a compact back position; and coupling the seat portion between first and second side skirts of the tray portion, the seat portion being in a non-use state with the arms in the compact arm position and the backrest in the compact back position.

In another embodiment, the method step of coupling includes coupling the seat portion to the tray portion with one or more straps. In another embodiment, the method step of moving includes moving the tray portion upward from the seat portion such that channels defined in an underside structure of the tray portion move from an engaged position with a top surface of the arms of the seat portion. In another embodiment, the method step of pivoting the arms includes pivoting the arms downward to overly a sitting surface of the seat portion. In still another embodiment, the method step of pivoting the backrest includes pivoting the backrest downward to overly the arms in the compact arm position. In yet another embodiment, the method further includes collapsing legs pivotably coupled to the seat portion and pivoting the collapsed legs under the seat portion.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
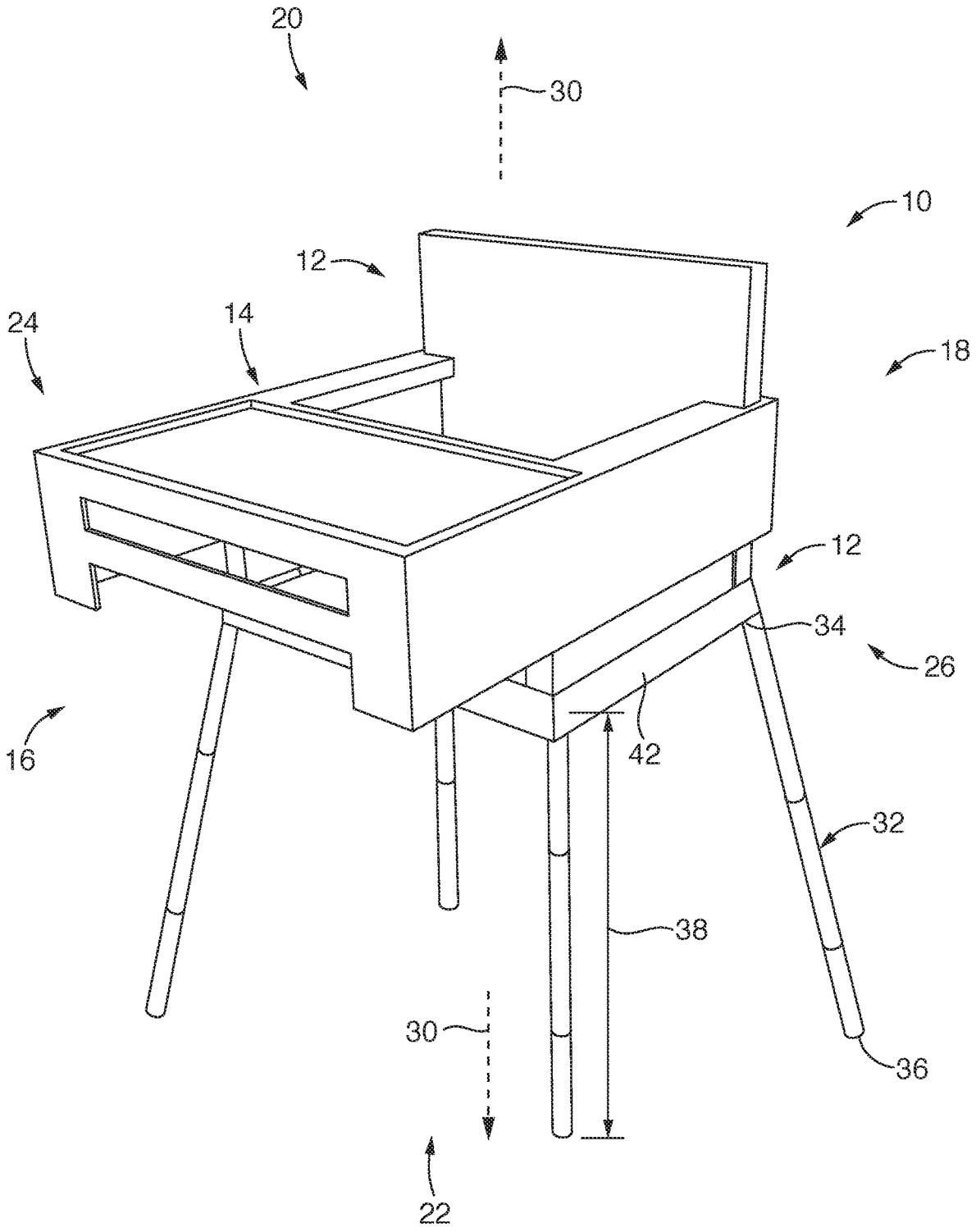
FIG. 1 is a perspective view of a modular chair, depicting the modular chair having a seat portion and a tray portion with legs extending from the seat portion, according to an embodiment of the present invention.
Figure 2:
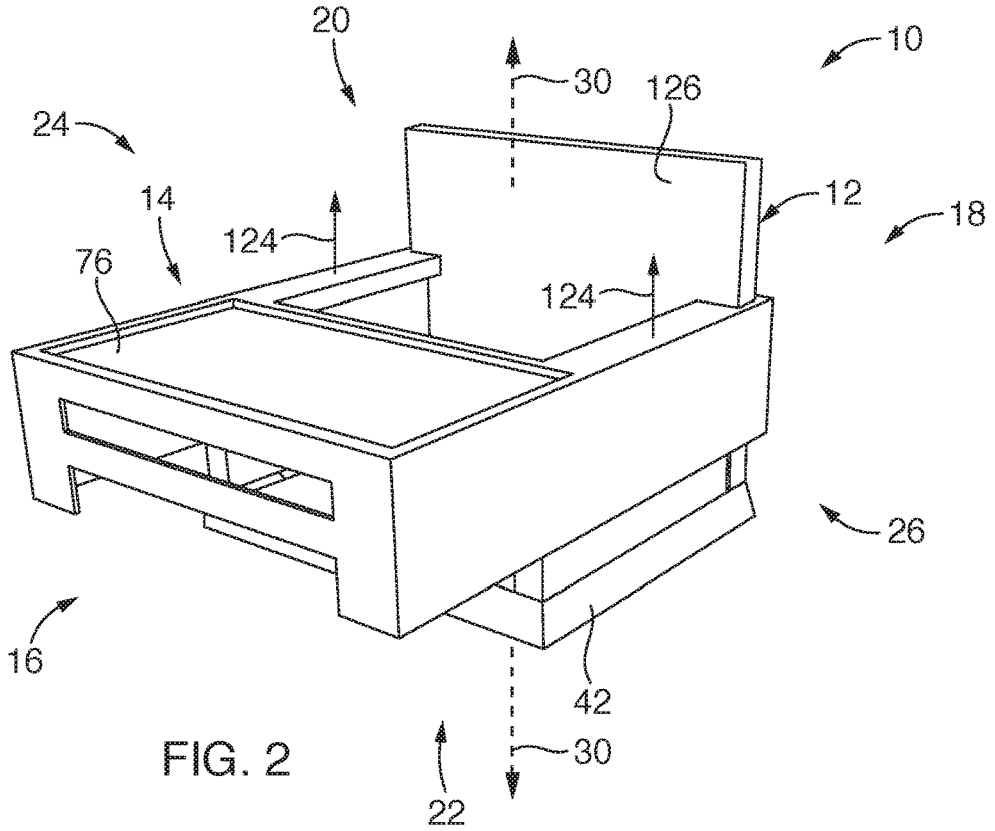
FIG. 2 is a perspective view of the modular chair of FIG. 1, depicting the legs moved to a collapsed position, according to another embodiment of the present invention.
Figure 3:
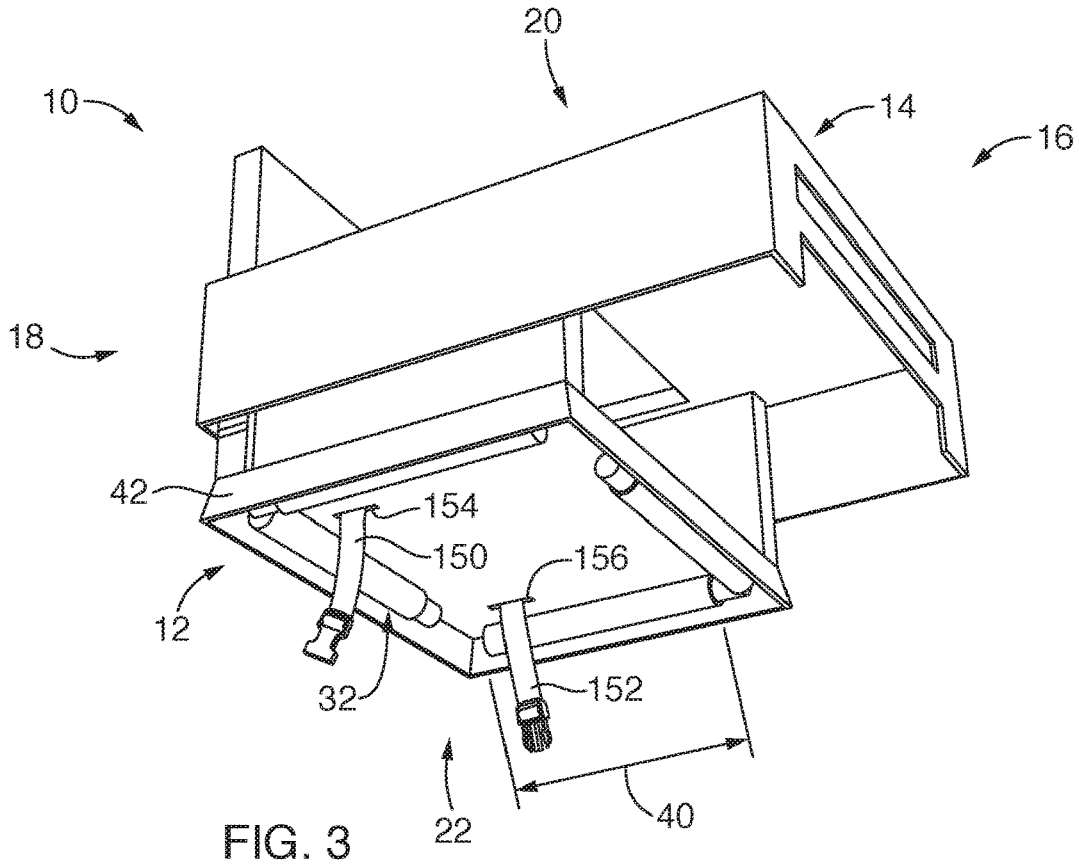
FIG. 3 is a perspective view of an underside of the modular chair, depicting the legs collapsed and compacted along the underside of the seat portion of the modular chair, according to another embodiment of the present invention.

Referring first to FIGS. 1-3, a modular chair 10 having modular components of a seat portion 12 and a tray portion 14 is provided. The modular chair 10 of the present invention may be employed as a "high chair" sized and configured to provide a safe seating arrangement for a child. Further, the modular chair 10 includes functionality that facilitates the modular chair 10 to be readily disassembled by separating the tray portion 14 from the seat portion 12, and then moving components of the modular chair 10 to one or more compact positions (see, e.g., FIGS. 10 and 11). The modular chair 10 is therefore highly portable so as to be easily moved from one location to another or stored on, for example, a shelf in a closet or stored in a vehicle with a minimally sized footprint.

The modular chair 10 may be positioned in a use state and a non-use compact state. In the use state, the tray portion 14 may be vertically and slidingly positioned over and with the seat portion 12 such that the tray portion 14 may be removably coupled to the tray portion 14. The modular chair 10, and its components, may extend to define a front side 16, a rear side 18, a top side 20, a bottom side 22, and first and second sides 24, 26. The front side 16 may be disposed opposite the rear side 18, the top side 20 may be disposed opposite the bottom side 22, and the first side 24 may be disposed opposite the second side 26 of the modular chair 10. Further, the modular chair 10 may define an axis 30 that may extend centrally and vertically through the modular chair 10 and extend substantially perpendicular relative to the floor, ground surface or common chair on which the modular chair 10 sits.

Figure 13:
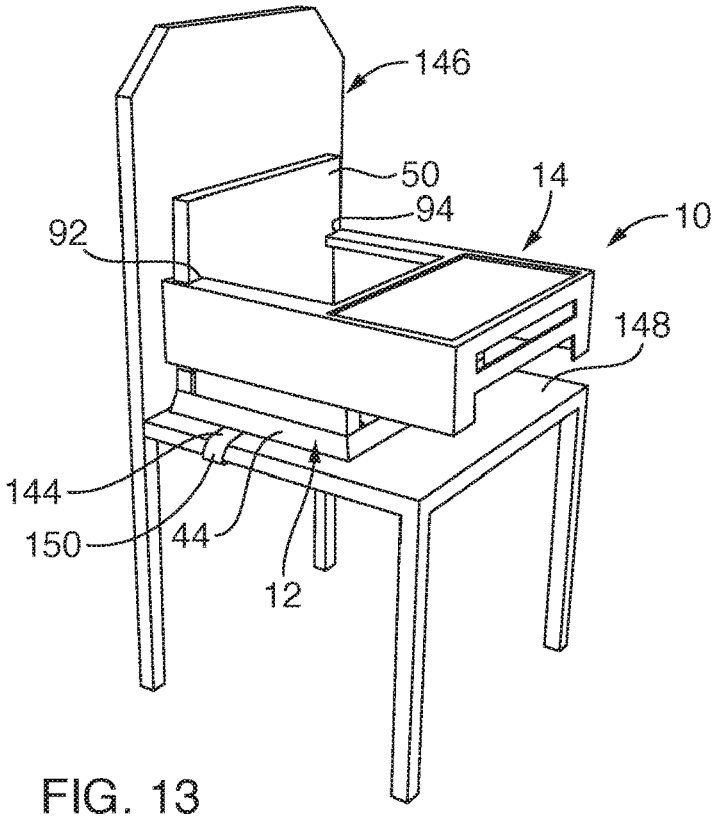
FIG. 13 is a perspective view of the modular chair, depicting the tray portion coupled to the seat portion on the common chair, according to another embodiment of the present invention.

Along the bottom side 22 of the modular chair 10, the modular chair 10 may include multiple telescoping legs 32, such as four legs, that may be pivotably coupled to the bottom side 22 of the seat portion 12. Such telescoping legs 32 may be sized and configured to support the modular chair 10. Further, the legs 32 may be moveable between an extended leg position and a compact leg position. Each of the telescoping legs 32 may extend between a first end 34 and an opposite second end 36, the second end 36 being a free end of the legs 32. The first end 34 or first end portion of the legs 32 may be pivotably coupled to coupling structure (not shown) along the bottom side 22 of the seat portion 12. Such legs 32 may each include telescoping structure, as known to one of ordinary skill in the art, to facilitate the legs to move between the extended leg position to exhibit an elongated length 38 (as depicted in FIG. 1) and the compact leg position to exhibit a shortened length 40. Further, as known to one of ordinary skill in the art, the legs 32 may include, for example, multiple pin and spring arrangements to maintain the legs in the fixed elongated length 38 and/or the shortened length 40. Upon being moved to the shortened length 40, the legs 32 may be moved to the compact leg position so as to be pivoted and tucked behind and adjacent a seat skirt 42 or seat apron of the seat portion 12, as depicted in FIG. 3. With this arrangement, the modular chair 10 may be employed in the use state with the legs 32 in the extended leg position, as shown in FIG. 1, as well as employed in the use state with the legs 32 moved to the compact leg position, as depicted in FIG. 13.

Figure 4:
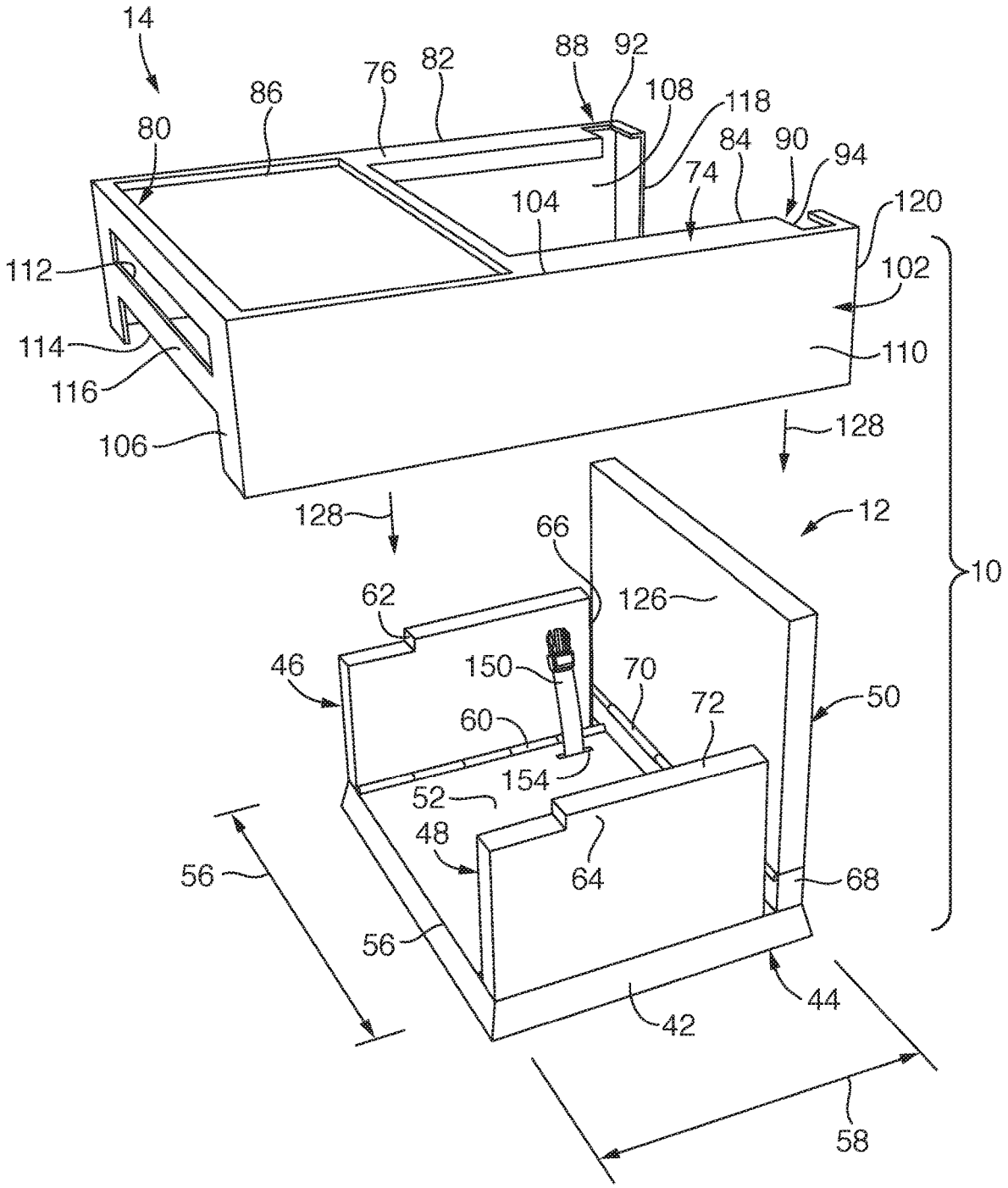
FIG. 4 is a perspective view of the modular chair, depicting the seat portion disassembled from the tray portion, according to another embodiment of the present invention.
Figure 5:
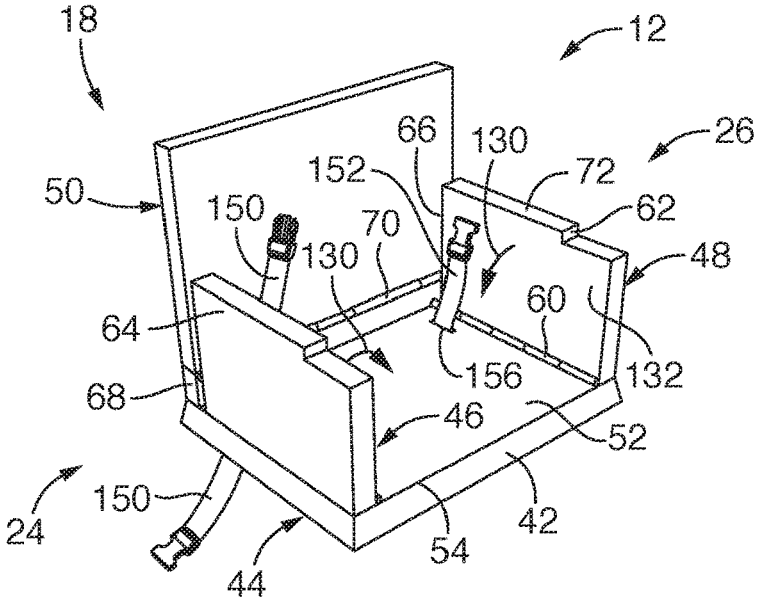
FIG. 5 is a perspective view of the seat portion of the modular chair, depicting arm portions and a back portion of the seat portion in upright positions, according to another embodiment of the present invention.

With reference to FIGS. 4 and 5, the seat portion 12 of the modular chair 10 may extend to define a base seat 44, first and second arms 46, 48 and a back 50 or backrest. The base seat 44 may define a horizontally extending flat surface, part of which may act as a sitting surface 52. The sitting surface 52 may extend to a base seat periphery 54 to define a width 56 and a depth 58 of the base seat 44. The before-described seat skirt 42 may extend downward from the base seat periphery 54 such that the seat skirt 42 extends downward to an extent for the legs 32 to be collapsed and tucked behind the seat skirt 42. The first and second arms 46, 48 may extend adjacent the base seat periphery 54 along the respective first and second sides 24, 26 of the base seat 44. Each of the first and second arms 46, 48 may be pivotably coupled to the base seat 44 with, for example, arm hinges 60, such that the first and second arms 46, 48 may move and rotate about the respective arm hinges 60 between an upright arm position and a pivoted or folded position (see FIG. 6). Further, the first and second arms 46, 48 may each include a notch 62 defined in a top portion 64 thereof. The notch 62 and the top portion 64 of the first and second arms 46, 48 may be sized and configured to cooperate with the underside structure of the tray portion 14. Further, each of the first and second arms 46, 48 extend to define a rear side arm surface 66 such that, upon the arms being in the upright position, the rear side arm surface 66 acts to maintain the back 50 of the seat portion 12 in an upright back position.

Along the rear side 18 of the base seat 44, the base seat 44 may include an upper extension 68 extending along the base seat periphery 54 of the base seat 44. The back 50 or backrest of the seat portion 12 may be pivotably coupled to the upper extension 68 with a back hinge 70. As such, the back 50 may be configured to pivot and rotate about the back hinge 70 between an upright back position and a pivoted or folded back position (see FIG. 7). Further, in the upright back position, the back 50 of the seat portion 12 may be positioned to extend about twice the height or substantially higher than a top surface 72 of the first and second arms 46, 48. With this arrangement, the seat portion 12 may be sized and configured such that, upon the first and second arms 46, 48 being in the upright arm position, the back 50 may be maintained in the upright back position such that the arms prevent the back from pivoting forward. Further, such back 50 of the seat portion 12 may cooperate with the tray portion 14 and act as a coupling mechanism between the seat and tray portions 12, 14.

Figure 8:
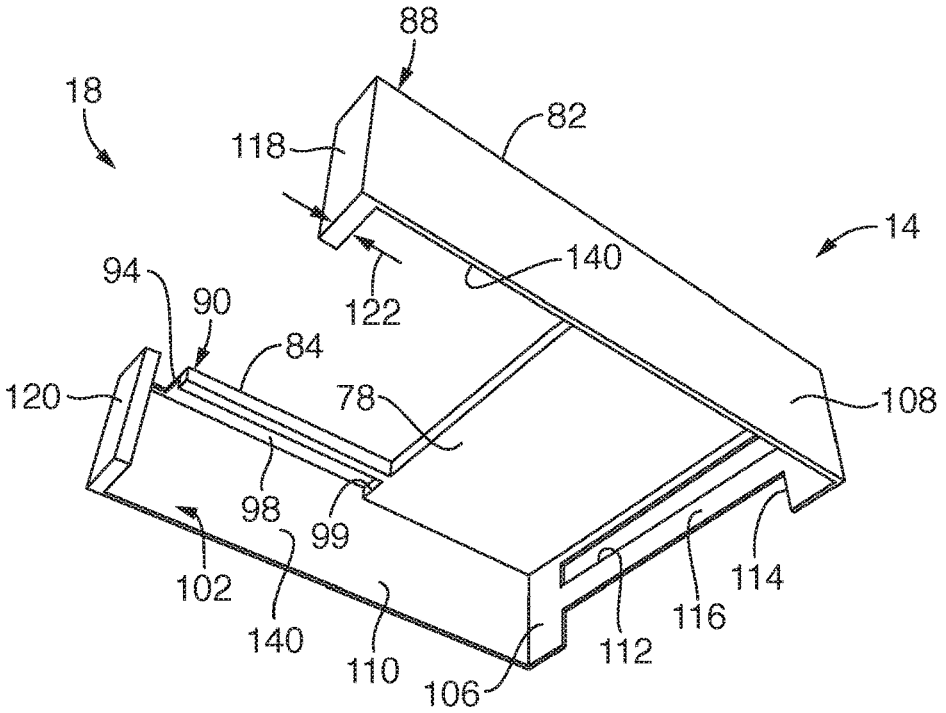
FIG. 8 is a perspective view of an underside of the tray portion, according to another embodiment of the present invention.

Now with reference to FIGS. 4 and 8, the tray portion 14 may be sized and configured to be removably coupled to the seat portion 12. The tray portion 14 may extend with a u-shaped structure 74, extending with an upward facing surface 76 or topside surface and an opposite underside surface 78 of the tray portion 14. The upward facing surface 76 may extend to define a tray region 80 and first and second arm rests 82, 84. The tray region 80 may include an indented region 86 defined in the upward facing surface 76 and may extend with a square or rectangular shape. The first and second arm rests 82, 84 may extend adjacently from respective rearward corners of the indented region 86 to extend rearward to respective ends of the first and second arm rests 82, 84 and to the rear side 18 of the tray portion 14. Further, the first and second arm rests 82, 84 extend to first and second rear end portions 88, 90 adjacent to the respective ends of the first and second arm rests 82, 84. Each of the first and second rear end portions 88, 90 define respective first and second c-shaped channels 92, 94. Such first and second c-shaped channels 92, 94 may be aligned relative to each other so as to face inward and cooperate with the back 50 of the seat portion 12.

As previously set forth, the underside surface 78 of the tray portion 14 may define structure to also cooperate with the seat portion 12. For example, in one embodiment, the underside surface 78 may extend to define arm channels 98 therein. Such arm channels 98 may extend along the underside surface 78 of each of the first and second arm rests 82, 84. Such arm channels 98 may extend so as to be sized and configured to correspond and receive the top portions 64 of the first and second arms 46, 48 of the seat portion 12. Further, the notch 62 defined in the top portion 64 of the first and second arms 46, 48 may correspond with an end 99 of each of the arm channels 98 defined in the underside surface 78 of the tray portion 14.

In some embodiments, the tray portion 14 may include a tray skirt 102 or tray apron such that the tray skirt 102 may extend downward from a tray periphery 104 of the upward facing surface 76 of the tray portion 14. The tray skirt 102 may define a front side skirt 106, a first side skirt 108, and a second side skirt 110. The front side skirt 106 may extend between the first and second side skirts 108, 110 and may extend downward relative to or from the upward facing surface 76 of the tray portion 14. The front side skirt 106 may define an elongated opening 112 therein. Further, the front side skirt 106 may also define an elongated notch 114 defined below the elongated opening 112. The portion between the elongated opening 112 and the elongated notch 114 may be sized and configured to define and act as a handle 116, discussed in further detail herein. The first side skirt 108 may extend between the front side skirt 106 and a first rear skirt 118. Similarly, the second side skirt 110 may extend between the front side skirt 106 and a second rear skirt 120. The first and second rear skirts 118, 120 may partially define the first and second c-shaped channels 92, 94, described above. Further, in one embodiment, the first and second rear skirts 118, 120 may exhibit a thickness that may be greater than the thickness of, for example, the front side skirt 106 and the first and second side skirts 108, 110. Such greater thickness of the first and second rear skirts 118, 120 may be necessary due to the c-shaped channels acting, at least in part, as the coupling mechanism between the seat portion 12 and the tray portion 14 of the modular chair 10.

Now with reference to FIGS. 2 and 4, the modular chair 10 may be readily disassembled and assembled. To disassemble or separate the tray portion 14 from the seat portion 12, the tray portion 14 may be moved upward in a vertical direction from the seat portion 12, as indicated by arrow 124 in FIG. 2. The vertical direction may extend along and substantially parallel with the axis 30 and may be defined as being substantially perpendicular relative to the upward facing surface 76 of the tray portion 14 and the sitting surface 52 of the seat portion 12. Such vertical direction may also extend substantially along and parallel with a plane defined by a front facing surface 126 of the back 50 of the seat portion 12. Upon moving the tray portion 14 upward, the top portion 64 of the first and second arms 46, 48 of the seat portion 12 are removed from the respective arm channels 98 (FIG. 8). Further, the back 50 of the seat portion 12 is also removed from the first and second c-shaped channels 92, 94. At this juncture, the tray portion 14 is disassembled and separated from the seat portion 12, as shown in FIG. 4. To reassemble the modular chair 10, the tray portion 14 may be moved downward in the vertical direction onto the seat portion 12, as indicated by arrow 128 in FIG. 4, such that the first and second c-shaped channels 92, 94 move over the back 50 of the seat portion 12. Otherwise said, the modular chair 10 may be assembled with the back 50 of the seat portion 12 being inserted through the c-shaped channels 92, 94 of the tray portion 14 until the top portion 64 of the first and second arms 46, 48 sit within the respective arm channels 98 defined in the underside surface 78 of the tray portion 14 (see FIG. 8). In this manner, the tray portion 14 may be prevented from moving laterally relative to the vertical direction and may only be moved vertically relative to the seat portion 12 and, further, the tray portion 14 may remain positioned on the seat portion 12 via the weight of the tray portion 14 and, as such, there may be minimized pinch points for a child sitting in the modular chair 10.

Figure 6:
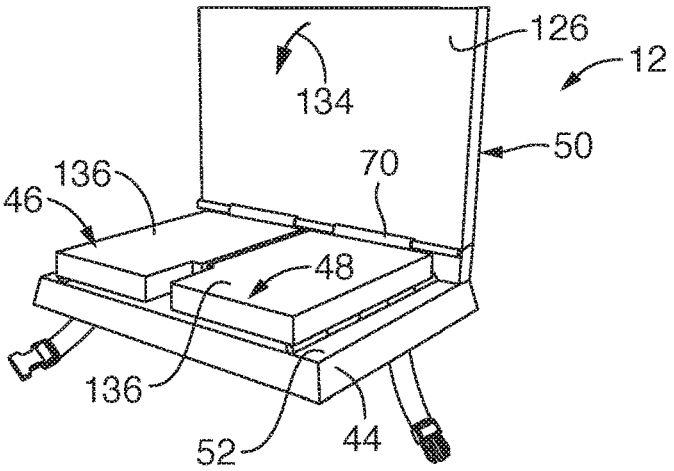
FIG. 6 is a perspective view of the seat portion of the modular chair, depicting arm portions pivoted to respective compact arm positions with the back portion in the upright position, according to another embodiment of the present invention.
Figure 7:
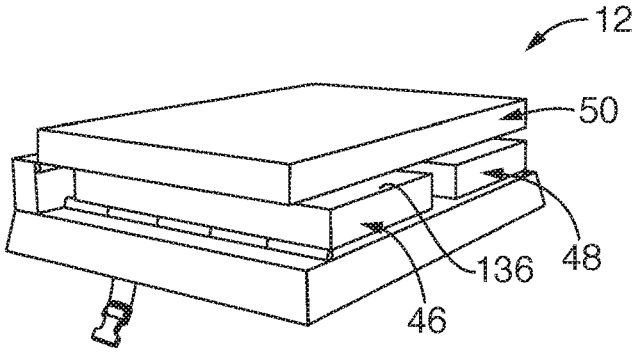
FIG. 7 is a perspective view of the seat portion of the modular chair, depicting the back portion pivoted over the arm portions to move the seat portion to a seat compacted position, according to another embodiment of the present invention.

Now with reference to FIGS. 5, 6 and 7, upon disassembling or separating the tray portion 14 from the seat portion 12, the seat portion 12 may be moved to a compact seat position. With respect to FIGS. 5 and 6, upon removing the tray portion 14 from the seat portion 12, the first and second arms 46, 48 may be in the upright arm position, and the back 50 in the upright back position (see FIG. 5). As previously set forth, the first and second arms 46, 48 may be pivotably coupled to the seat base 50 such that, the first and second arms 46, 48 may be pivoted inward, as indicated by rotational arrow 130. The first and second arms 46, 48 may be pivoted from the upright position to a compact arm position or folded arm position such that an inner surface 132 of the first and second arms 46, 48 may overly or be positioned against the sitting surface 52 of the base seat 44 (see FIG. 6). With respect to FIGS. 6 and 7, upon moving the first and second arms 46, 48 to the compact arm position, the back 50 may then be freely pivoted or rotated about the back hinge 70, as indicated by rotational arrow 134, so that the front facing surface 126 of the back 50 may overly or be positioned against an outer surface 136 of the first and second arms 46, 48 (see FIG. 7). In this manner, the seat portion 12 may be moved to the compact seat position to exhibit a minimal footprint. As can be readily appreciated, the seat portion 12 can be readily moved to a seat use position, as shown in FIG. 5, from the compact seat position by first rotating the back 50 to the upright back position, and then rotating the first and second arms 46, 48 to the upright arm position. With the seat portion 12 in the seat use position, the seat portion 12 can be readily assembled with the tray portion 14 (FIG. 4), as previously set forth.

Figure 9:
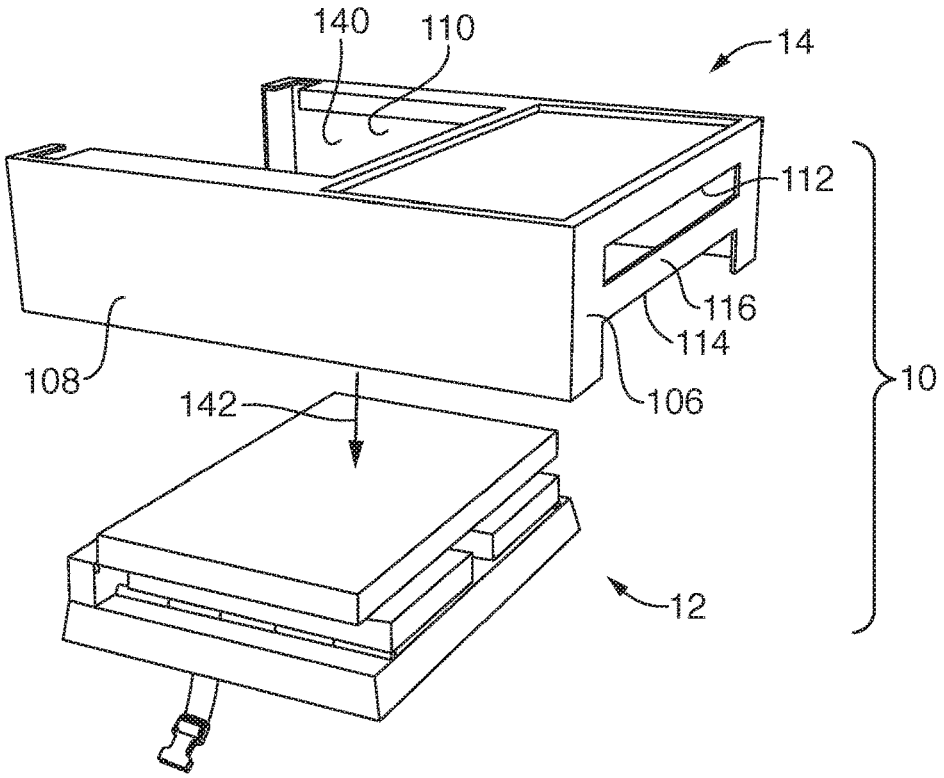
FIG. 9 is a perspective view of the modular chair, depicting the tray portion positioned above the compact seat portion in a disassembled pre-compact position, according to another embodiment of the present invention.
Figure 10:
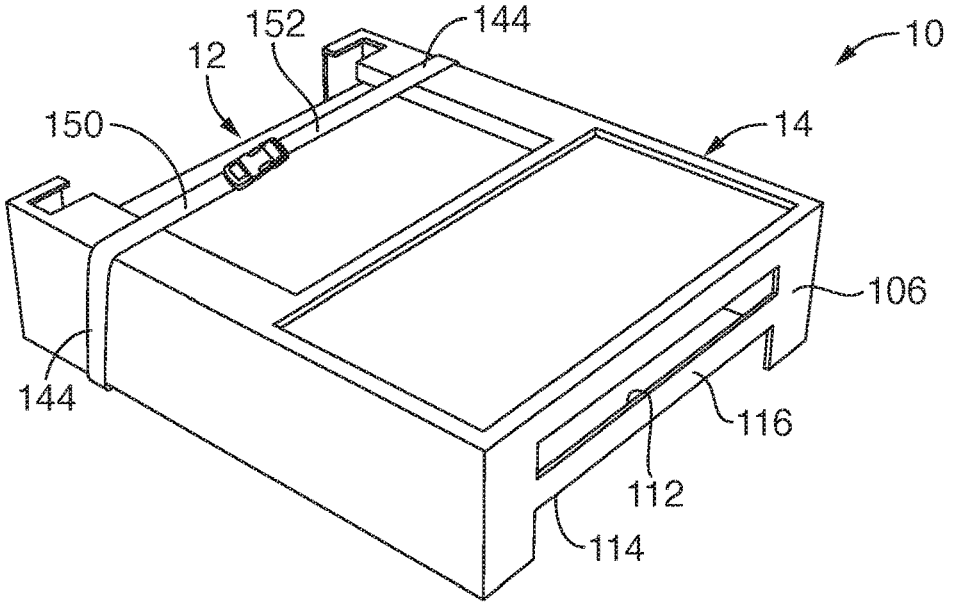
FIG. 10 is a top perspective view of the modular chair, depicting the modular chair in a fully compacted position, according to another embodiment of the present invention.
Figure 11:
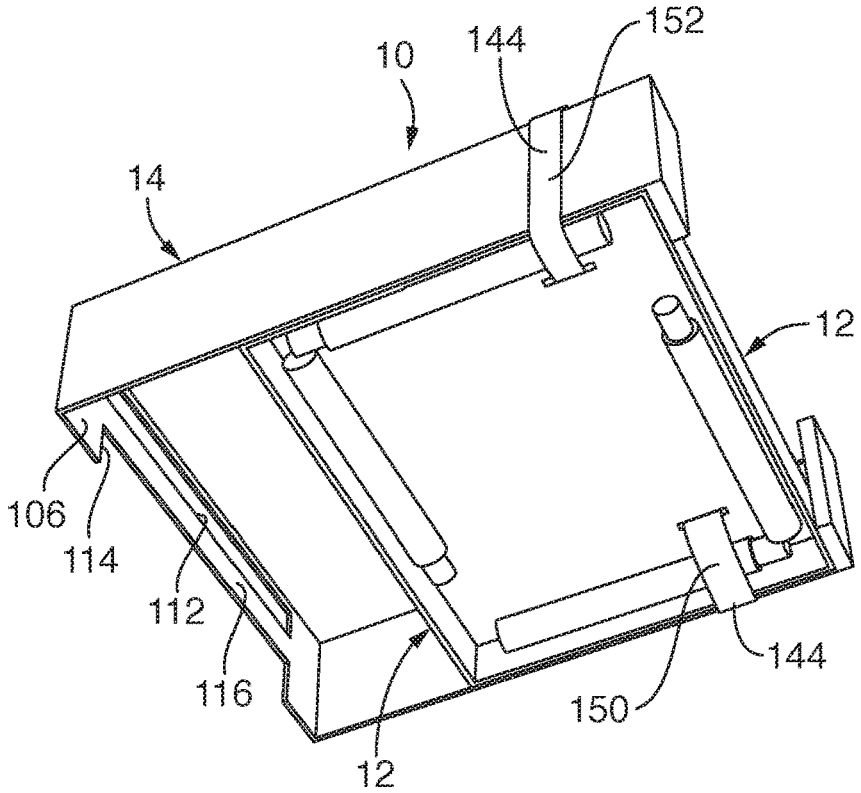
FIG. 11 is a bottom perspective view of the modular chair in the fully compacted position, according to another embodiment of the present invention.

With respect to FIGS. 8 and 9, upon moving the seat portion 12 to the compact seat position, the seat portion 12 may be reassembled with the tray portion 14 to a fully compact position and assembly. For example, the seat portion 12 may be positioned within a space 140 defined between the first and second side skirts 108, 110 of the tray portion 14. The tray portion 14 may be placed over and moved, for example, downward onto the seat portion 12, as indicated by downward arrow 142. With reference to FIGS. 9, 10 and 11, once the tray portion 14 is positioned over the seat portion 12, the seat portion 12 may be removably coupled to the tray portion 14 with, for example, one or more straps 144. In this manner, the modular chair 10 may be moved to a minimized size to facilitate enhanced portability for traveling with or storing the modular chair 10 with a minimized footprint, for example. Further, with the modular chair 10 in the fully compact position, the handle 116 defined by the elongated opening 112 and elongated notch 114 formed in the front side skirt 106 may be employed by one carrying the modular chair 10 to further enhance portability of the modular chair 10.

Figure 12:
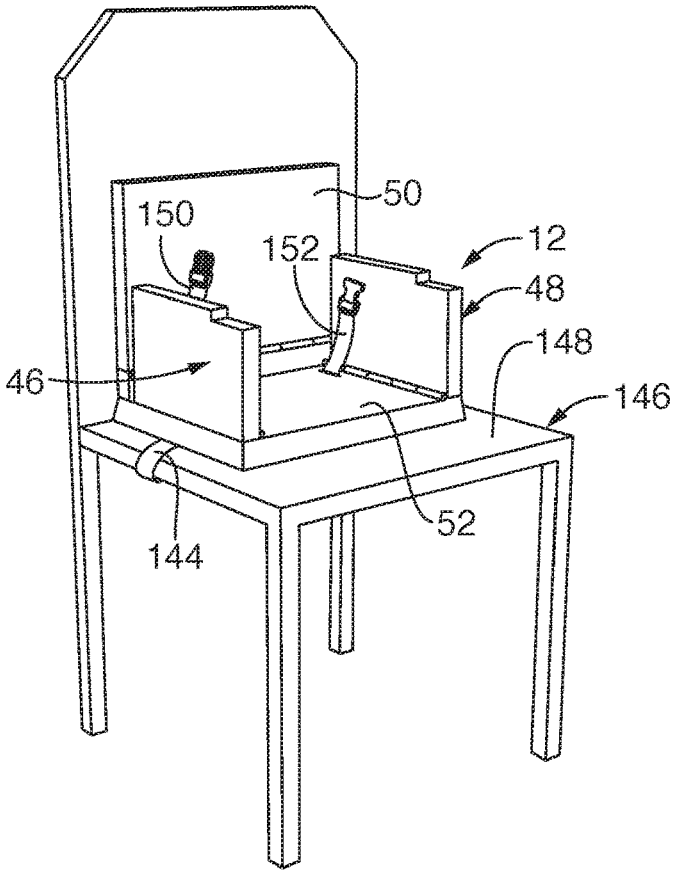
FIG. 12 is a perspective view of the seat portion of the modular chair, depicting the seat portion positioned on a common chair with the legs moved to the compact legs position, according to another embodiment of the present invention.

With reference to FIGS. 12 and 13, the one or more straps 144 employed for holding the seat portion 12 in its compacted seat position within the space 140 of the tray portion 14, as previously set forth and shown in FIGS. 10 and 11, may be used for strapping the seat portion to a common chair 146, for example. Upon positioning the seat portion 12 on a seat 148 of the common chair 146, the back 50 and first and second arms 46, 48 of the seat portion 12 may be moved to their respective upright positions, as depicted. The tray portion 14 and seat portion 12 may be assembled together by inserting the back 50 of the seat portion 12 through the first and second c-shaped channels 92, 94 of the tray portion 14, as previously described herein. The one or more straps 144 extending from the base seat 44 may then be wrapped under the seat 148 of the common chair 146, coupled to each other, and cinched tight. In this manner, the modular chair 10 may be employed with a common chair 146.

Now with reference to FIGS. 3, 4 and 5, in another embodiment, the one or more straps 144 of the seat portion 12 may include a first strap 150 and a second strap 152 each of which may correspond and extend through a respective first slot 154 and a second slot 156 defined in the seat portion 12. For example, the first slot 154 may be defined to extend through the base seat 44 and, more specifically, may extend between the sitting surface 52 and an underside of the base seat 44 and be positioned adjacent the first arm 46 of the seat portion 12. Similarly, the second slot 156 may be defined to extend through the base seat 44 and, more specifically, may extend between the sitting surface 52 and an underside of the base seat 44 so as to be positioned adjacent the second arm 48 of the seat portion 12. Each of the first and second slots 154, 156 defined in the base seat 44 may be sized and configured to hold the respective first and second straps 150, 152 in a sliding manner. Further, the first strap 150 may include male and female connectors coupled to opposite ends of the first strap 150. Similarly, the second strap 152 may also include male and female connectors coupled to opposite ends of the second strap 152. As such, one end of each of the first and second straps 150, 152 extending above the sitting surface 52 of the seat portion 12 may exhibit the male and female connectors, which may be coupled together to strap a child, for example, sitting on the sitting surface 52 of the seat portion 12 (see e.g., FIG. 12). Similarly, as previously set forth, the other end of each of the first and second straps 150, 152 extending below the underside of the base seat 44 may be coupled together with their respective male and female connectors to couple the seat portion 12 to a chair 146, as depicted in FIGS. 12 and 13, or to couple the seat portion 12 to the tray portion 14, as depicted in FIGS. 10 and 11.

In one embodiment, the tray portion 14 of the modular chair 10 may be formed as a one-piece, seamless monolithic structure. The seat portion 12 and the tray portion 14 may be formed from a suitable polymeric material, as known to one of ordinary skill in the art. Further, the seat portion 12 and the tray portion 14 may be formed by employing various molding techniques, as known to one of ordinary skill in the art. The one or more straps 144 may be webbed straps made from a woven polymeric material or any other suitable material. The one or more straps may include typical polymeric buckle structure, or the like, suitable for coupling and cinching the one or more straps 144 together.

While the invention may be susceptible to various modifications and alternative forms, specific embodiments have been shown by way of example in the drawings and have been described in detail herein. Further, the structural features of any one embodiment disclosed herein may be combined or replaced by any one of the structural features of another embodiment set forth herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A modular chair system for a child, comprising:

a seat portion including a base seat, a back, a first arm and a second arm, the base seat extending to define an upper seat surface and a seat underside, the first and second arms each pivotably coupled to the base seat so as to be moveable between an upright arm position and a compact arm position, the back pivotably coupled to the base seat so as to be pivotably movable between an upright back position and a compact back position; and a tray portion including an upward facing surface defining a tray region and first and second arm rests, the first and second arm rests of the tray portion having underside structure extending to define respective first and second arm channels therein, each of the first and second arm channels including two surfaces facing each other that each extend directly from an underside surface, the first arm sized to be positioned between the two surfaces facing each other of the first arm channel, the second arm sized to be positioned between the two surfaces facing each other of the second arm channel, the first and second arm rests extending to rear end portions, the rear end portions at least partially extending to define respective first and second back channels therein, the tray portion being removably coupled to the seat portion with the back positioned within the back channels and the first and second arms being positioned in the respective first and second arm channels.

2. The modular chair system of claim 1, wherein the seat portion comprises multiple telescoping legs pivotably coupled to the seat underside, the multiple telescoping legs moveable between an elongated leg position and a compact shortened leg position, the compact shortened leg position being pivotable to extend along the seat underside of the seat portion.

3. The modular chair system of claim 1, wherein, upon the tray portion being coupled to the seat portion, the tray portion is removable from the seat portion with movement in a single direction such that the upward facing surface moves directly away from the upper seat surface of the seat portion.

4. The modular chair system of claim 3, wherein, upon the tray portion being removed from the seat portion, the first and second arms are pivotably movable to the compact arm position so that each of the first and second arms are positioned along the upper seat surface, and the back is pivotably moveable to the compact back position so that the back is positioned over the first and second arms to minimize the seat portion to a seat compacted position.

5. The modular chair system of claim 4, wherein, upon the seat portion being moved to the seat compacted position, the seat portion may be positioned and held between the first and second arm rests of the tray portion with a coupling structure.

6. The modular chair system of claim 1, wherein the tray portion is a one-piece seamless monolithic structure.

7. The modular chair system of claim 1, further comprising one or more straps coupled to the seat portion.

8. A modular chair system for a child, comprising:

a seat portion sized and configured to be moved between a seat structure position and a compact folded position, the seat portion defining a sitting surface, the seat structure position of the seat portion defining a back, a first arm and a second arm each extending upright and vertically relative to the sitting surface;

a tray portion sized and configured to be assembled and coupled to the seat portion in both the seat structure position and the compact folded position, the tray portion having an upward facing surface defining a tray region and first and second arm rests, the tray region and the first and second arm rests defining a u-shaped structure, the first and second arm rests each extending with an underside surface and two surfaces extending from the underside surface so as to define respective first and second arm channels, the two surfaces extending to face each other such that the first arm of the seat portion is configured to be positioned between the two surfaces of the first arm channel and such that the second arm of the seat portion is configured to be positioned between the two surfaces of the second arm channel, the first and second arm rests extending to respective rear end portions, the rear end portions each defining a c-shaped channel therein;

wherein, upon the seat portion being in the seat structure position, the back of the seat portion is sized and configured to be inserted through the c-shaped channel of the tray portion such that the upward facing surface of the tray portion moves closer to the sitting surface of the seat portion in a direction substantially perpendicular to the sitting surface of the seat portion.

9. The modular chair system of claim 8, wherein the seat portion comprises a base seat with the first and second arms extending upright from the base seat in the seat structure position, the first and second arms pivotably coupled to the base seat such that the first and second arms are movable to pivot and overly the sitting surface in the compact folded position.

10. The modular chair system of claim 9, wherein the back is pivotably coupled to the base seat such that the back is moveable to pivot and overly the pivoted first and second arms to move the seat portion to the compact folded position.

11. The modular chair system of claim 8, wherein the first and second arm channels defined in the tray portion are configured to maintain the first and second arms in an upright position relative to the sitting surface.

12. The modular chair system of claim 8, wherein the seat portion comprises a seat underside, the seat underside including multiple telescoping legs pivotably coupled thereto, the multiple telescoping legs moveable between an elongated leg position and a compact shortened leg position, the compact shortened leg position being pivotable to extend along the seat underside of the seat portion.

13. The modular chair system of claim 8, wherein the tray portion is a one-piece seamless monolithic structure.

14. The modular chair system of claim 8, further comprising one or more straps coupled to the seat portion, the one or more straps sized and configured to couple the seat portion, upon the seat portion being in the compact folded position, against an underside of the tray portion.

15. A method for collapsing a modular chair, the method comprising:

providing a tray portion coupled to seat portion with a backrest of the seat portion maintained within c-shaped channels defined in the tray portion and with first and second arms of the seat portion positioned within first and second arm channels defined along underside structure of the tray portion, the first and second arm channels each including two surfaces that face each other that each extend directly from an underside surface of the tray portion;

moving the tray portion in a vertical direction from the seat portion by sliding the c-shaped channels of the tray portion from the backrest of the seat portion;

pivoting the first and second arms of the seat portion from an upright position to a compact arm position;

pivoting the backrest from an upright position to a compact back position; and coupling the seat portion between first and second side skirts of the tray portion, the seat portion being in a non-use state with the arms in the compact arm position and the backrest in the compact back position.

16. The method according to claim 15, wherein the coupling comprises coupling the seat portion to the tray portion with one or more straps.

17. The method according to claim 15, wherein the moving comprises moving the tray portion upward from the seat portion such that the first and second arm channels defined in the underside structure of the tray portion move from an engaged position with a top surface of the first and second arms of the seat portion.

18. The method according to claim 15, wherein the pivoting the first and second arms comprises pivoting the first and second arms downward to overly a sitting surface of the seat portion.

19. The method according to claim 15, wherein the pivoting the backrest comprises pivoting the backrest downward to overly the first and second arms in the compact arm position.

20. The method according to claim 15, further comprising collapsing legs pivotably coupled to the seat portion and pivoting the collapsed legs under the seat portion.

* * * * *